United States Patent [19]

Arendale

[11] 4,023,994

[45] May 17, 1977

[54] SOLID PROPELLANT CONTAINING FERROCENE PLASTICIZER

[75] Inventor: William F. Arendale, Huntsville, Ala.

[73] Assignee: Thiokol Corporation, Newtown, Pa.

[22] Filed: Sept. 9, 1963

[21] Appl. No.: 307,729

[52] U.S. Cl. ..... 149/19.2; 149/18; 149/19.1; 149/19.4; 149/19.6; 149/19.9; 149/19.91; 149/42; 149/44; 149/76

[51] Int. Cl.[2] ..... C06B 45/10

[58] Field of Search ..... 149/17, 18, 19

[56] References Cited

UNITED STATES PATENTS

| | | | |
|---|---|---|---|
| 3,002,830 | 10/1961 | Barr | 149/19 |
| 3,109,761 | 11/1963 | Cobb | 149/19 |

*Primary Examiner*—Stephen J. Lechert, Jr.
*Attorney, Agent, or Firm*—Stanley A. Marcus; William R. Wright, Jr.

EXEMPLARY CLAIM

1. A solid composite type propellant composition comprising as a base propellant an oxidizer, a metallic fuel and fuel binder and between 0.1 and 10% by weight of a ferrocene plasticizer that is selected from the group consisting of mono- and di-substituted ferrocenes wherein the substituents are selected from the group consisting of —R, —COR, —$CO_2$R, —CH(OH)R, and —CH(R′$CO_2$)R wherein R and R′ are selected from the group consisting of alkyl, cycloalkyl, alkenyl and cycloalkenyl radicals, the carbon chains of which may be interrupted by oxygen.

13 Claims, No Drawings

SOLID PROPELLANT CONTAINING FERROCENE PLASTICIZER

This invention relates to composite solid rocket propellants, more particularly to a process for modifying the burning rate of such propellants and the product produced thereby, and is a continuation of co-pending application Ser. No. 227,652, filed Sept. 27, 1962, now abandoned.

Composite solid rocket propellants commonly consist of one or more solid inorganic or organic oxidizer materials uniformly dispersed in a matrix of fuel-binder material. In addition, such propellants often contain solid and/or liquid additives to enhance the ballistic and/or physical performance of the finished product. Composite solid propellants are commonly made by mixing the solid ingredients with the liquid matrix ingredients, which are solidified after a uniform dispersion of the solid materials has been obtained. Typical composite solid propellants and the processing thereof are fully described in the many U.S. patents found in Class 149 (formerly Class 52.5).

One additive commonly used in composite solid propellants is a catalytic combustion modifier, also called a combustion or burning rate catalyst. Ferrocene (dicyclopentadienyl iron) has been used as a catalytic combustion modifier in composite solid propellants for many years despite disadvantages which limit its use. It is a solid having only limited solubility in the commonly-used fuel-binder matrix materials. Thus, only a limited amount of ferrocene will be dissolved in the matrix, larger amounts being dispersed as solid particles. The microscopically uniform distribution necessary for the maximum catalytic effect is, therefore, impossible to obtain.

A more significant disadvantage of ferrocene, however, is its physical instability in composite propellants. Although the causative mechanism is not fully known, but may be associated with the compound's inherently high vapor pressure, ferrocene is gradually lost from composite solid propellants in which it is used. The loss is greatest at the elevated temperatures commonly encountered during the processing of propellants, but occurs even during storage of the finished propellant charges. Thus, the ferrocene content of a composite solid propellant charge does not remain constant, as desired, but gradually decreases as ferrocene is lost. Also, part of the ferrocene lost from the mass of the propellant charge is deposited on the exposed surfaces of the charge, such as the central perforation of a star-perforated charge, causing difficulty in igniting the charge.

Many unsuccessful attempts have been made to overcome or circumvent the undesirable loss of ferrocene from composite solid propellants. Excess ferrocene has been added during processing, since this is when much of the loss occurs, so that the desired level will be attained, at least temporarily. This procedure will not prevent the loss of catalyst during storage. Complex polymeric forms of ferrocene have been substituted for the simple compound, but have been found to be only marginally better than ferrocene as far as loss is concerned, and inferior in respect of catalytic activity.

It is an object of the present invention, therefore to provide a novel process whereby the disadvantages associated with the use of ferrocene as a catalytic combustion modifier are overcome. It is a further object of this invention to provide a novel process whereby more uniform distribution and enhanced efficiency of the catalytic combustion modifier are obtained and processing of composite solid propellants is made easier through increased fluidity of the uncured mix.

These, and other objects of the present invention, are achieved through the incorporation into composite solid propellants of organo-iron compounds combining in a single molecule a ferrocenyl radical with an organic radical which acts as a plasticizer.

In addition to a catalytic combustion modifier, composite solid propellants commonly contain a plasticizer to enhance physical performance, particularly at lower temperatures. Suitable plasticizers are widely known in the art and will be found in many of the propellants of Class 149. Organic esters, such as dibutyl phthalate, dioctyl adipate, etc., are commonly used plasticizers for composite solid propellants. Other organic compounds, such as long-chain hydrocarbons, complex ethers, and the like are also used as plasticizers.

By chemically combining the catalytic ferrocenyl radical and the plasticizing organic radical of these two commonly used additives into a single molecular compound, the problems associated with the use of ferrocene, as such, are largely overcome. Since suitable ferrocene-plasticizers will be liquid at the usual processing conditions, more uniform distribution will be obtained through solution and increased mix fluidity. Since the ferrocene-plasticizer will be in solution in the fuel-binder matrix, and the plasticizer portion of the combined molecule will be associated with the matrix material, the ferrocene-plasticizer will be better retained in the propellant charge than would ferrocene.

An unexpected advantage resulting from the replacement of separate ferrocene and plasticizer by a unimolecular ferrocene-plasticizer may be a result of the more uniform distribution obtained through solution. A detectably greater increase in burning rate for the same catalyst concentration (calculated as ferrocene) is frequently obtained with ferrocene-plasticizers. As the catalytic activity of a ferrocene-plasticizer should be directly related to the proportion of ferrocene in the combined molecule, it would be expected, for example, that the increase in propellant burning rate obtained with a 2 percent concentration of a ferrocene-plasticizer containing 50 percent ferrocene would be same as that obtained with a 1 percent concentration of ferrocene. A number of suitable ferrocene-plasticizers produce a greater burning rate increase than anticipated from their ferrocene content, and such ferrocene-plasticizers are preferred for use when maximum increase in burning rate is the primary objective.

Compounds combining ferrocene with organic radicals and suitable for use as ferrocene-plasticizers have been known for many years. Their use as catalytic combustion modifiers has, however, never before been recognized nor suggested. Their only suggested utility in the prior art has been as haematinics, pigments, anti-oxidants, etc.

Suitable ferrocene-plasticizers may readily be synthesized by standard reaction processes. Acyl-substituted ferrocenes, for example, may be prepared by Friedel-Crafts acylation of ferrocene with acid halides and anhydrides in the presence of suitable Lewis acid catalysts. Such reactions have been reported by R. B. Woodward et al, J. Am. Chem. Soc., 74, 3458 (1952) and others, as well as being used in the synthesis of a number of ferrocene derivatives found in U.S. patents in Class 260–439.

Catalytic hydrogenation of acyl-substituted ferrocenes results in alkyl-substituted ferrocenes. More advantageously, Clemmensen reduction of acyl-substituted ferrocenes may be employed in the preparation of alkyl-substituted ferrocenes. Acylation and Clemmensen reduction of acyl-substituted ferrocenes has been reported by Martin Vogel et al, J. Org. Chem., 22, 1016 (1957) and by others. E. L. DeYoung, J. Org. Chem., 26, 1312 (1961) presents data on mono-acyl and mono-alkyl substituted ferrocenes useful as ferrocene-plasticizers.

Following the method of U.S. Pat. No. 2,683,157, carboxycyclopentadienyl(cyclopentadienyl)iron, commonly called ferrocene carboxylic acid, may be synthesized. This acid, and others similarly prepared, may be reacted with hydroxyl compounds, for example, to give ferrocene esters. One such ester, the n-butyl carbitol ester of ferrocene carboxylic acid, is described in copending application Ser. No. 227,653, assigned to the same assignee as the present application.

Other ferrocene compounds useful as ferrocene-plasticizers or as intermediates in their preparation, are described in U.S. Pat. Nos. 2,810,737; 3,036,106; and others of Class 260–439. The synthesis of suitable ferrocene-plasticizers, however, does not form a part of the present invention, and the foregoing art is cited only as example.

Composite solid rocket propellants in which the above-described ferrocene-plasticizers may be advantageously used are found in Class 149 (formerly Class 52.5), with a number being found in Class 60-35.6. Composite solid propellants are well-established art; and since their basic compositions and processing are essentially unaltered and are not critical to the present invention, extensive description of such known propellants is not deemed necessary.

As is well-known, composite solid propellants consist of one or more inorganic or organic oxidizer materials dispersed in a fuel-binder matrix. Powdered metals may also be incorporated into such propellants, as may other additives. Commonly used oxidizers include, among others, organic and inorganic nitrate and perchlorate salts. Binder or matrix materials include, but are not limited to, thermoplastic and thermosetting natural and synthetic plastics, resins and elastomers such as asphalt, vinyl plastics, natural and synthetic rubbers, polysulfide rubbers, polyurethanes, epoxy resins, epoxy and aziridinyl-cured carboxy modified hydrocarbon polymers, etc. U.S. Pat. No. 3,002,830 describes many such composite solid propellants and their processing.

In the process and product of the present invention, the basic composition (oxidizer, metallic fuel and fuel-binder) of a composite solid propellant is essentially unaltered. To this basic composition, a ferrocene-plasticizer is added, resulting in a composite solid propellant differing from the basic composition only in the essential incorporation of the ferrocene-plasticizer. The ferrocene-plasticizer may suitably be incorporated into the propellant at any stage of processing prior to cure. Most suitably, the ferrocene plasticizer would be incorporated into the propellant mix after all or most of the solid ingredients (oxidizer powdered metal, etc.) had been blended with the binder polymer and before addition of the curing agent. Alternatively, in the case of an extremely viscous polymer, the ferrocene-plasticizer may be blended with the polymer to reduce its viscosity, making the incorporation of solid ingredients easier. A specific order of addition of the ferrocene-plasticizer is not critical to the present process, the most advantgeous point of addition being determined by the basic composition and processing schedule of the composite solid propellant into which the ferrocene-plasticizer is incorporated.

In Table I, there are presented a number of exemplary ferrocene-plasticizers, including ester, acyl and alkyl derivatives, with their molecular weights and ferrocene content.

TABLE I

| Nr. | Compound | Type | Mol. Wt. | % Ferrocene |
|---|---|---|---|---|
| | Ferrocene | | 186.03 | 100 |
| I | Methyl ferrocene-carboxylate | ester | 244.07 | 76 |
| II | Ethyl ferrocenecarboxylate | ester | 258.10 | 72 |
| III | Propyl ferrocene-carboxylate | ester | 272.13 | 68 |
| IV | Butyl ferrocene-carboxylate | ester | 286.15 | 65 |
| V | Dodecyl ferrocene-carboxylate | ester | 398.36 | 47 |
| VI | n-Butylcarbitol ferrocene-carboxylate | ester | 374.26 | 50 |
| VII | Propionyl ferrocene | acyl | 242.10 | 77 |
| VIII | Butanoyl | acyl | 256.12 | 73 |
| IX | Valeryl | acyl | 270.15 | 68 |
| X | n-Butyl ferrocene | alkyl | 242.14 | 77 |
| XI | n-Amyl | alkyl | 256.17 | 73 |
| XII | 2-Methoxyethyl-β-ferrocenoylpropionate | ester | 344.19 | 54 |

In Table II, the catalytic effect of a number of these ferrocene-plasticizers upon a composite solid propellant consisting of 68 percent ammonium perchlorate and 16 percent aluminum powder in a binder matrix consisting of an epoxide-cured polybutadiene acrylic acid copolymer is compared with that of ferrocene.

TABLE II

| Additive | % Additive | % Ferrocene | % Rate Increase Measured | % Rate Increase Expected |
|---|---|---|---|---|
| Ferrocene + Plasticizer[1] | 2 | 1 | 52 | |
| I | 1 | 0.76 | 41 | 42 |
| II | 1 | 0.72 | 37 | 39 |
| III | 1 | 0.68 | 37 | 37 |
| V | 1 | 0.47 | 15 | 26 |
| VI | 1 | 0.50 | 22 | 28 |
| | 2 | 1.00 | 37 | 52 |

[1]Plasticizer TP-90B di-n-butylcarbitol formal (Thiokol Chemical Corporation)

In Table III, a similar comparison is made in a propellant consisting of 68 percent ammonium perchlorate and 16 percent aluminum in an aziridinyl-cured carboxy-terminated polymer binder matrix, as in U.S. Pat. No. 3,087,844.

TABLE III

| Additive | % Additive | % Ferrocene | % Rate Increase Measured | % Rate Increase Expected |
|---|---|---|---|---|
| Ferrocene + Plasticizer[1] | 2 | 1 | 65 | |
| | 3 | 2 | 106 | |
| IV | 2 | 1.3 | 68 | 82 |
| VI | 2 | 1.0 | 65 | 65 |
| VII | 2 | 1.54 | 102 | 92 |
| VIII | 2 | 1.46 | 108 | 89 |
| IX | 2 | 1.36 | 97 | 85 |
| X | 2 | 1.54 | 111 | 92 |
| | 3 | 2.31 | 124 | 113 |
| XI | 2 | 1.46 | 100 | 89 |
| XII | 2 | 1.08 | 78 | 71 |

TABLE III-continued

| Additive | % Additive | % Ferrocene | % Rate Increase Measured | Expected |
|---|---|---|---|---|
| | 3 | 1.62 | 106 | 95 |

[1]Plasticizer TP-90B di-n-butylcarbitol formal (Thiokol Chemical Corporation)

Table IV compares the activity of the same ferrocene-plasticizer in three different composite propellants. Each propellant contains 68 percent ammonium perchlorate and 16 percent aluminum. The hydrocarbon binder is that of Table III, the polyurethane binder is an isocyanate polymer (Adiprene L, DuPont)-castor oil elastomer, and the polysulfide binder is a polysulfide polymer (LP-3, Thiokol Chemical Corporation) cured with GMF and DPG as in U.S. Pat. No. 2,997,376.

TABLE IV

| Binder | Burning Rate No catalyst | 2% catalyst | % Increase |
|---|---|---|---|
| Hydrocarbon | 0.37 | 0.78 | 111 |
| Polyurethane | 0.27 | 0.59 | 119 |
| Polysulfide | 0.77 | 1.09 | 42 |

While the present invention has been described by means of specific example, it should not be limited thereto, for obvious modifications will occur to those skilled in the art without departing from the spirit of the invention or the scope of the subjoined claims.

What is claimed is:

1. A solid composite type propellant composition comprising as a base propellant an oxidizer, a metallic fuel and fuel binder and between 0.1 and 10% by weight of a ferrocene plasticizer that is selected from the group consisting of mono- and di-substituted ferrocenes wherein the substituents are selected from the group consisting of —R, —COR, —$CO_2$R, —CH(OH)R, and —CH(R′$CO_2$)R wherein R and R′ are selected from the group consisting of alkyl, cycloalkyl, alkenyl and cycloalkenyl radicals, the carbon chains of which may be interrupted by oxygen.

2. A solid composite type propellant composition, according to claim 1, wherein said ferrocene plasticizer is methyl ferrocenecarboxylate.

3. A solid composite type propellant composition, according to claim 1, wherein said ferrocene plasticizer is ethyl ferrocenecarboxylate.

4. A solid composite type propellant composition, according to claim 1, wherein said ferrocene plasticizer is propyl ferrocenecarboxylate.

5. A solid composite type propellant composition, according to claim 1, wherein said ferrocene plasticizer is butyl ferrocenecarboxylate.

6. A solid composite type propellant composition, according to claim 1, wherein said ferrocene plasticizer is dodecyl ferrocenecarboxylate.

7. A solid composite type propellant composition, according to claim 1, wherein said ferrocene plasticizer is n-Butylcarbitol ferrocenecarboxylate.

8. A solid composite type propellant composition, according to claim 1, wherein said ferrocene plasticizer is propionyl ferrocene.

9. A solid composite type propellant composition, according to claim 1, wherein said ferrocene plasticizer is butanoyl.

10. A solid composite type propellant composition, according to claim 1, wherein said ferrocene plasticizer is valeryl.

11. A solid composite type propellant composition, according to claim 1, wherein said ferrocene plasticizer is n-Butyl ferrocene.

12. A solid composite type propellant composition, according to claim 1, wherein said ferrocene plasticizer is n-Amyl.

13. A solid composite type propellant composition, according to claim 1, wherein said ferrocene plasticizer is 2-Methoxyethyl-$\beta$-ferrocenoylpropionate.

* * * * *